US011913764B2

(12) United States Patent
Padgett et al.

(10) Patent No.: US 11,913,764 B2
(45) Date of Patent: Feb. 27, 2024

(54) CARTRIDGE CASE HAVING A NECK WITH INCREASED THICKNESS

(71) Applicant: PCP TACTICAL, LLC, Vero Beach, FL (US)

(72) Inventors: Charles Padgett, Vero Beach, FL (US); Lanse Padgett, Vero Beach, FL (US)

(73) Assignee: PCP TACTICAL, LLC, Vero Beach, FL (US)

( * ) Notice: Subject to any disclaimer, the term of this patent is extended or adjusted under 35 U.S.C. 154(b) by 0 days.

(21) Appl. No.: 17/068,285

(22) Filed: Oct. 12, 2020

(65) Prior Publication Data

US 2021/0223008 A1 Jul. 22, 2021

Related U.S. Application Data

(62) Division of application No. 15/956,051, filed on Apr. 18, 2018, now Pat. No. 10,809,043.

(60) Provisional application No. 62/487,086, filed on Apr. 19, 2017.

(51) Int. Cl.

| | |
|---|---|
| ***F42B 5/30*** | (2006.01) |
| ***F42B 5/307*** | (2006.01) |
| ***F42B 5/02*** | (2006.01) |

(52) U.S. Cl.

CPC ..... *F42B 5/025* (2013.01); *F42B 5/30* (2013.01); *F42B 5/307* (2013.01)

(58) Field of Classification Search

CPC .... F42B 5/02; F42B 5/025; F42B 5/26; F42B 5/30; F42B 5/307; F42B 5/313

USPC ..... 102/464, 465, 466, 467, 469, 470

See application file for complete search history.

(56) References Cited

U.S. PATENT DOCUMENTS

| | | | |
|---|---|---|---|
| 2,862,446 | A | 12/1958 | Ringdal |
| 3,749,023 | A | 7/1973 | Kawaguchi et al. |
| 4,157,684 | A | 6/1979 | Clausser |
| 4,173,186 | A | 11/1979 | Dunham |

(Continued)

FOREIGN PATENT DOCUMENTS

| | | | | |
|---|---|---|---|---|
| EP | 3392602 | A1 * | 10/2018 | ..... F42B 5/025 |
| WO | 2013/016730 | A1 | 1/2013 | |

(Continued)

OTHER PUBLICATIONS

Engineering Polymers: Part and Mold Design Thermoplastics a Design Guide, Covestro LLC Applications Development Group ( © 2015) (PDF version now marked as Last Modified Feb. 1, 2016), https://www.solutions.covestro.com/-/media/covestro/solution-center/brochures/pcs/brochures/part-and-mold-design-brochure.pdf.

(Continued)

*Primary Examiner* — James S Bergin

(74) *Attorney, Agent, or Firm* — Troutman Pepper Hamilton Sanders LLP

(57) ABSTRACT

A high strength polymer-based cartridge casing inclosing a volume includes a first end having a mouth, a neck extending away from the mouth, a shoulder extending below the neck and away from the first end, a cartridge body formed below the shoulder, an insert attached to the cartridge body opposite the shoulder, and a projectile disposed in the mouth having a particular caliber. The neck has a neck thickness that is about 25% to about 125% greater than a standard neck thickness for the particular caliber as detailed by a standards organization. Also, the neck, the shoulder, and the cartridge body are formed from a polymer.

8 Claims, 6 Drawing Sheets

(56) References Cited

U.S. PATENT DOCUMENTS

| | | | | |
|---|---|---|---|---|
| 9,182,204 | B2 | 11/2015 | Maljkovic et al. | |
| 9,188,412 | B2 * | 11/2015 | Maljkovic | F42B 5/30 |
| 9,335,137 | B2 | 5/2016 | Maljkovic et al. | |
| 9,441,930 | B2 * | 9/2016 | Burrow | F42B 5/02 |
| 9,528,799 | B2 | 12/2016 | Maljkovic | |
| 9,587,919 | B2 * | 3/2017 | Daniau | F42B 5/025 |
| 10,809,043 | B2 * | 10/2020 | Padgett | F42B 5/307 |
| 10,948,273 | B2 * | 3/2021 | Burrow | F42B 5/313 |
| 2011/0214583 | A1 * | 9/2011 | Dutch | F42B 5/26 102/464 |
| 2014/0076188 | A1 * | 3/2014 | Maljkovic | F42B 5/025 102/467 |
| 2016/0040970 | A1 | 2/2016 | Maljkovic et al. | |
| 2017/0082409 | A1 | 3/2017 | Burrow | |

FOREIGN PATENT DOCUMENTS

| | | | | |
|---|---|---|---|---|
| WO | WO-2013016730 | A1 * | 1/2013 | F42B 33/001 |
| WO | 2015/130409 | A2 | 9/2015 | |
| WO | WO-2015130409 | A2 * | 9/2015 | F42B 5/025 |

OTHER PUBLICATIONS

Plastic Properties Table, Curbell Plastics, Inc., https://curbellplastics.com/Research-Solutions/Plastic-Properties (see version © 2016 at The Internet Archive, https://web.archive.org/web/20160430225124/https://curbellplastics.com/Research-Solutions/Plastic-Properties).

Metal to Plastic: Design Flexibility, M. Crawford, ASME.org, The American Society of Mechanical Engineers (Sep. 18, 2013 ), https://www.asme.org/topics-resources/content/metal-to-plastic-design-flexibility.

* cited by examiner

NOTE
B = BASIC
(XX.XX) = MILLIMETERS
⊗ = HEADSPACE DIMENSION
Δ = REFERENCE DIMENSION
* = DIMENSIONS ARE TO INTERSECTION OF LINES
ALL CALCULATIONS APPLY AT MAXIMUM MATERIAL CONDITIONS (MMC)

CARTRIDGE CASE HAVING A NECK WITH INCREASED THICKNESS

CROSS-REFERENCE TO RELATED APPLICATION

This application is a Divisional of U.S. application Ser. No. 15/956,051 filed Apr. 18, 2018, which in turn claims priority to U.S. Provisional Application 62/487,086 filed Apr. 19, 2017. These applications are incorporated herein in their entirety by reference.

FIELD OF THE INVENTION

The present subject matter relates to ammunition articles with plastic components such as cartridge casing bodies, and, more particularly, to making ammunition articles with a neck thicker than the standard neck thickness for a particular caliber.

BACKGROUND

It is well known in the industry to manufacture cartridge cases from either brass or steel. Typically, industry design calls for materials that are strong enough to withstand extreme operating pressures and which can be formed into a cartridge case to hold the bullet, while simultaneously resist rupturing during the firing process.

Conventional ammunition typically includes four basic components, that is, the bullet, the cartridge case holding the bullet therein, a propellant used to push the bullet down the barrel at predetermined velocities, and a primer, which provides the spark needed to ignite the powder which sets the bullet in motion down the barrel.

The cartridge case is typically formed from brass and is configured to hold the bullet therein to create a predetermined resistance, which is known in the industry as bullet pull. The cartridge case is also designed to contain the propellant media as well as the primer.

However, brass is heavy, expensive, and potentially hazardous. For example, the weight of .50 caliber ammunition is about 60 pounds per box (200 cartridges plus links).

The bullet is configured to fit within an open end or mouth of the cartridge case and is typically manufactured from a soft material, such as, for example only, lead. The bullet is accepted into the mouth of the cartridge, and then the cartridge alone can be crimped to any portion of the bullet to hold the bullet in place in the cartridge case. Though, typically, the cartridge case is crimped to a cannelure of the bullet.

The propellant is typically a solid chemical compound in powder form commonly referred to as smokeless powder. Propellants are selected such that when confined within the cartridge case, the propellant burns at a known and predictably rapid rate to produce the desired expanding gases. As discussed above, the expanding gases of the propellant provide the energy force that launches the bullet from the grasp of the cartridge case and propels the bullet down the barrel of the gun at a known and relatively high velocity.

The primer is the smallest of the four basic components used to form conventional ammunition. As discussed above, primers provide the spark needed to ignite the powder that sets the bullet in motion down the barrel. The primer includes a relatively small metal cup containing a priming mixture, foil paper, and relatively small metal post, commonly referred to as an anvil.

When a firing pin of a gun or firearm strikes a casing of the primer, the anvil is crushed to ignite the priming mixture contained in the metal cup of the primer. Typically, the primer mixture is an explosive lead styphnate blended with non-corrosive fuels and oxidizers which burns through a flash hole formed in the rear area of the cartridge case and ignites the propellant stored in the cartridge case. In addition to igniting the propellant, the primer produces an initial pressure to support the burning propellant and seals the rear of the cartridge case to prevent high-pressure gases from escaping rearward. It should be noted that it is well known in the industry to manufacture primers in several different sizes and from different mixtures, each of which affects ignition differently.

The cartridge case, which is typically metallic, acts as a payload delivery vessel and can have several body shapes and head configurations, depending on the caliber of the ammunition. Despite the different body shapes and head configurations, all cartridge cases have a feature used to guide the cartridge case, with a bullet held therein, into the chamber of the gun or firearm.

The primary objective of the cartridge case is to hold the bullet, primer, and propellant therein until the gun is fired. Upon firing of the gun, the cartridge case seals the chamber to prevent the hot gases from escaping the chamber in a rearward direction and harming the shooter. The empty cartridge case is extracted manually or with the assistance of gas or recoil from the chamber once the gun is fired.

As shown in FIG. 1, a bottleneck cartridge case 10 has a body 11 formed with a shoulder 12 that tapers into a neck 13 having a mouth at a first end. Note that the shoulder 12 has a uniform thickness, or width. Further, the angle of the shoulder 12 on the outside of the cartridge case 10 is the same as the angle of the shoulder 12 inside the case 10. In the prior art, these dimensions are dictated by the caliber of the cartridge. A primer holding chamber 15 is formed at a second end of the body opposite the first end. A divider 16 separates a main cartridge case holding chamber 17, which contains a propellant, from the primer holding chamber 15, which communicate with each other via a flash hole channel 18 formed in the web area 16. An exterior circumferential region of the rear end of the cartridge case includes an extraction groove 19*a* and a rim 19*b*.

The cartridge case and the firearm chambered for that cartridge have to function together. For consistency throughout the industry and the world, dimensions of the cartridge case and the firearm chambers for a particular caliber are very tightly dimensionally controlled. A variety of organizations exist that provide standards in order to help assure smooth functioning of all ammunition in all weapons. Non-limiting examples of these organizations include the Sporting Arms and Ammunition Manufacturers' Institute (SAAMI) in USA, the Commission Internationale Permanente pour l'epreuve des armes a feu portatives (CIP) in Europe, as well as various militaries around the globe as transnational organizations such as the North Atlantic Treaty Organization (NATO).

SAAMI is the preeminent North American organization maintaining and publishing standards for dimensions of ammunition and firearms. Typically, SAAMI and other regulating agencies will publish two drawings, one that shows the minimum (MIN) dimensions for the chamber (i.e. dimensions that the chamber cannot be smaller than), and one that shows the maximum (MAX) ammunition external dimensions (i.e. dimensions that the ammunition cannot exceed). The MIN chamber dimension is always larger than the MAX ammunition dimension, assuring that the ammunition round will fit inside the weapon chamber. All published SAAMI, NATO, US Department of Defense (US DOD) and CIP drawings are incorporated here by reference.

It is important to note that SAAMI compliance and standardization is voluntary. SAAMI does not regulate all possible calibers, especially those for which the primary use is military (for example, .50 BMG (12.7 mm) calibers are maintained by the US DOD), or the calibers which have not yet been submitted (wildcat rounds, obscure calibers, etc.)

In general, new cases developed for established calibers (for which chamber/ammunition drawings are published) have to follow the published external dimensions very closely in order to function in the maximum number of weapons. This has also been true for development of cases with alternative case materials, such as for example polymers.

However, for a standard bullet caliber, some of the dimensions of the cartridge are too weak to withstand the pressures generated during the firing of the round when the cartridge is not made of brass. It is an object of the present invention to develop dimensions for a polymer cartridge case to withstand the pressures generated for each particular caliber round.

SUMMARY

Current brass case necks are designed to obturate and seal the chamber to prevent gasses from leaking back into the chamber. Polymer has reduced tensile strength relative to brass, thus has a potential to tear. Polymer cases with the thicker neck provide additional strength to compensate for the reduced inherent mechanical strength.

An example of which is a high strength polymer-based cartridge casing inclosing a volume, with a first end having a mouth, a neck extending away from the mouth, a shoulder extending below the neck and away from the first end, a cartridge body formed below the shoulder, an insert attached to the cartridge body opposite the shoulder, and a projectile disposed in the mouth having a particular caliber. The neck can have a neck thickness that is about 25% to about 125% greater than a standard neck thickness for the particular caliber as detailed by a standards organization. Also, the neck, the shoulder, and the cartridge body are formed from a polymer. Note that all of the other standard dimensions for the cartridge can remain standard for that projectile and case.

In other examples, the neck thickness that is about 25% to about 90% greater than a standard neck thickness for the particular caliber as detailed by the standards organization. Alternately, or in addition to, the neck can have a length greater than a standard neck length for the particular caliber as detailed by the standards organization. The shoulder has a shoulder angle and the angle can remain constant for the particular caliber as detailed by the standards organization.

A further example of a high strength polymer-based cartridge casing inclosing a volume, has a first end having a mouth, a neck extending away from the mouth, comprising a neck thickness, and a shoulder extending below the neck and away from the first end. The shoulder can have a headspace reference point used by a standards organization to determine a headspace for the cartridge. The cartridge can have a headspace reference point diameter being the diameter of the shoulder at the headspace reference point as detailed by the standards organization, a cartridge body formed below the shoulder, an insert attached to the cartridge body opposite the shoulder, and a projectile disposed in the mouth having a caliber. The neck thickness can now be a ratio based on a standard neck thickness for the projectile caliber as detailed by a standards organization, the headspace reference point diameter and the projectile caliber. The ratio can range from greater than a first ratio of the standard neck thickness to the projectile caliber to less than or equal to a second ratio of the headspace reference point diameter to the projectile caliber.

In examples, the second ratio is between 10.6% and 49.1% or the neck thickness varies along a length of the neck. Also, the neck thickness can vary in the same proportion that the standard neck thickness for the projectile caliber as detailed by a standards organization varies.

Another example of a high strength polymer-based cartridge casing inclosing a volume, has a neck thickness greater than a standard neck thickness for the particular caliber as detailed by a standards organization, as above, and a sloped neck edge proximate the first end. A slope of the sloped neck edge can be defined by an angle and the angle is between 20° and 80°.

In yet other embodiments, the ammunition casing has a caliber selected from the group of .22, .22-250, .223, .243, .25-06, .264, .270, .277, .300, .30-30, .30-40, 30.06, .303, .308, .338, .357, .38, .40, .44, .45, .45-70, .50 BMG, 5.45 mm, 5.56 mm, 6.0 mm, 6.5 mm, 6.8 mm, 7 mm, 7.62 mm, 8 mm, 9 mm, 10 mm, 12.7 mm, 14.5 mm, 20 mm, 25 mm, 30 mm, and 40 mm.

In still yet other embodiments at least the neck portion and a portion of the body portion are formed of a polymeric material.

The polymer used can be of any known polymer and additives, but in the present example, uses a nylon polymer with glass fibers, carbon fibers, nanoclay or carbon nanotubes. The polymers which can be used include polycarbonate, PP, PA6, PA66, PBT, PET, thermoplastic polyurethane, polyamides, nylon 6,66, nylon 12, nylon 12 copolymers, PA610, PA612, LCP, PPSU, PPA, PPS, PEEK, PEKK, polyester copolymers, PSU, PAEK and PES. Further, the portion of the cartridge that engages the extractor of the firearm can be made from heat strengthened steel for normal loads.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

The present example provides a cartridge case body strong enough to withstand gas pressures that equal or surpass the strength required of brass cartridge cases under certain conditions, e.g. for both storage and handling. At the same time, the cartridge can be easily produced and still maintain surpass brass cartridges.

Figure 1:
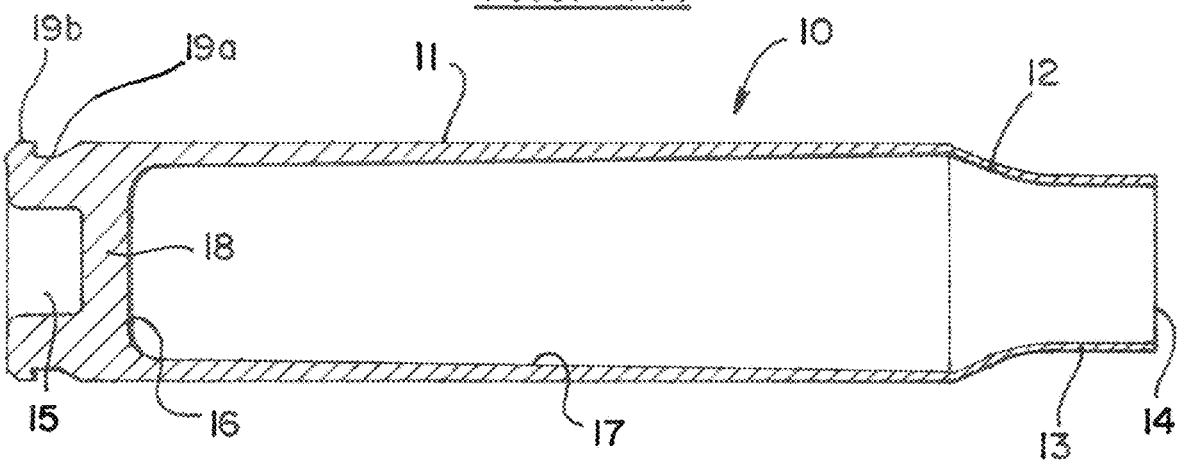
FIG. 1 Prior Art
FIG. 1 is a cross sectional view of a conventional bottleneck cartridge case.
Figure 4:
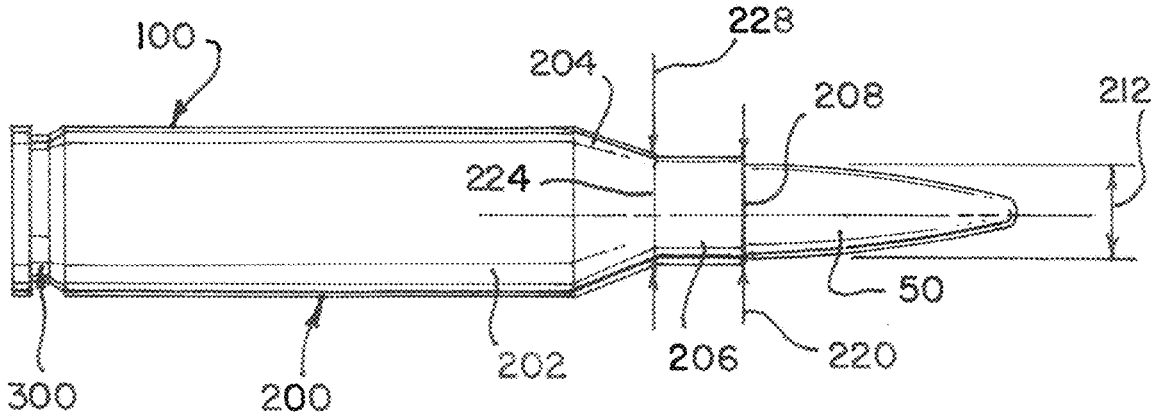
FIG. 4 is a profile view of a cartridge of the present invention.
Figure 5:
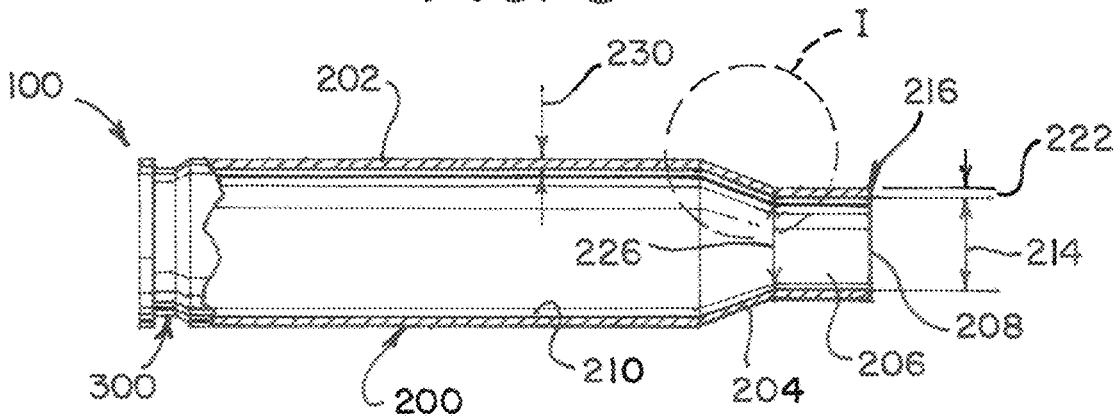
FIG. 5 is a cross-section view of the cartridge of FIG. 4.

Referring now to FIGS. 4 and 5, a profile view and cross-section of a bottleneck cartridge case 100 is illustrated. The cartridge case 100 includes a polymer component 200 and an insert 300. In this example, the polymer component 200 is made of a polymer while the insert 300 is made from a metal, an alloy of metals, or an alloy of a metal and a non-metal.

The polymer used is lighter than brass. A high impact polymer can be used where the glass content is between 0%-50%. An example of an impact modified polymer is polyetherimide (PEI). Further examples include using polycarbonate, polysulfones (PSU), polyphenylsulfone (PPSU), siloxane, polycarbonates, and any co-polymers, alloys or blends of the above.

The insert 300 can be made of brass or steel, and, in examples, stainless steel. The nature of the features allows examples of the insert to be made of "softer" steel. Other examples use heat treated carbon steel, 4140. The 4140 steel has a rating on the Rockwell "C" scale ("RC") hardness of about 20 to about 50. However, any carbon steel with similar properties, other metals, metal alloys or metal/non-metal alloys can be used to form the inserts.

The insert 300 has features as described in the applications as incorporated by reference below. The insert includes a primer pocket, and flash hole to assist in igniting the powder. The outside of the insert has an extraction rim and groove to assist in loading, unloading and seating the cartridge in the chamber of a weapon.

In an example, the polymer component 200 is made of high impact polymer combined with the insert 300 made of brass or steel that result in a cartridge that is approximately 50% lighter than a brass formed counterpart. This weight savings in the unloaded cartridge produces a loaded cartridge of between 25%-30% lighter than the loaded brass cartridge depending on the load used, i.e. which projectile, how much powder, and type of powder used.

FIG. 4 illustrates the polymer component 200 with a body 202 which transitions into a shoulder 204 that tapers into a neck 206 having a mouth 208. The body 202 generally forms a propellant chamber 210, as this holds the propellant (not illustrated) to propel the projectile (not illustrated) typically fitted into the mouth 208. The propellant chamber 210 can be a volume from the insert 300 to approximately the shoulder 204. A bottom of a projectile 50 extends into the mouth 208 and past the neck 206, and this can act as the other "end" to the propellant chamber 210.

Every projectile 50 has a caliber, or diameter 212, sized for the same caliber barrel. The projectile diameter 212 leads to the size of the opening of the mouth 208. This opening size is a first internal diameter 214 of the neck 206 at the mouth 208, or a first end 216 of the neck 206. The first end 216 also has an outer diameter 220 and the difference between the first internal diameter 214 and the first outer diameter 220 is the first end thickness 222. The neck 206 has a second end 224 opposite the mouth 208 and interfaces with the shoulder 204. The second end 224 also has a second internal diameter 226 and a second outer diameter 228, the difference between which is a second end thickness 230.

For any given SAAMI standard caliber there is a caliber neck thickness $T_{standard}$ and the thickness of the neck 206 is typically uniform from the mouth 208 to the shoulder 204. In a first example of the present invention the first end thickness 222 and the second end thickness 230 are uniform and result in an inventive neck thickness $T_{improved}$. Here, $T_{improved}$ is greater than $T_{standard}$ by a range of about 25% to about 125%. Other ranges are about greater that 25%-90%; 25%-95%; 25%-100% and 25%-110% of standard.

Figure 2A:
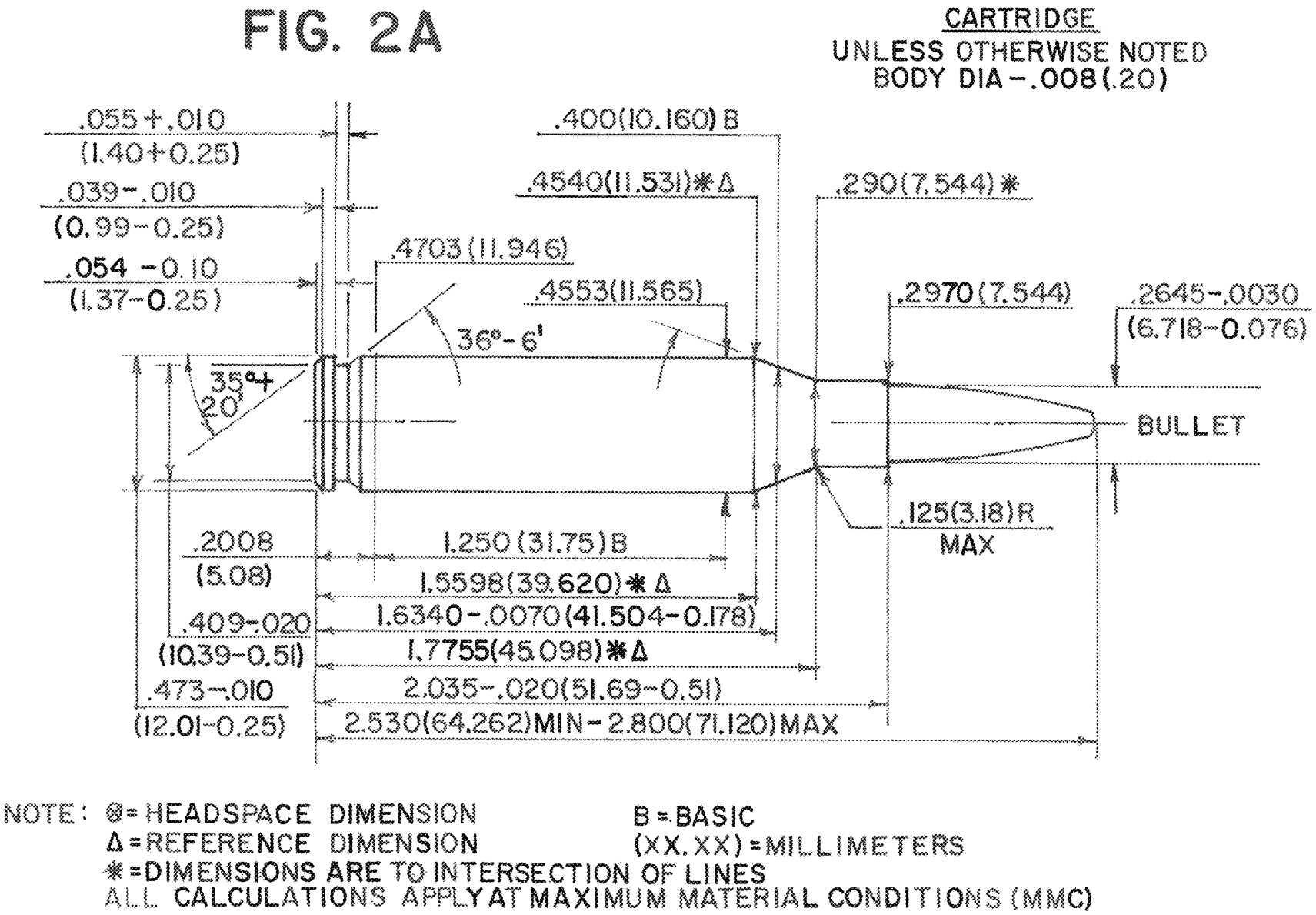
FIG. 2A is a SAAMI performance sheet with dimensions for a .260 Remington round.
Figure 6:
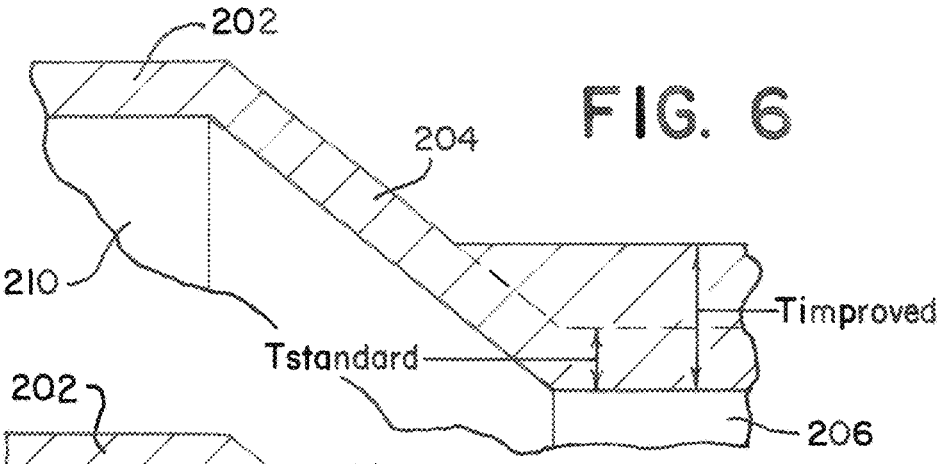
FIG. 6 is a magnified partial cross-section illustrating the thicker neck.

In comparison to an actual cartridge, FIG. 2A illustrates that for a .260 caliber bullet, the bullet diameter is 0.2645 inches (for this example, we will ignore the tolerances) which we can approximate for the interior diameter of the neck and the outer neck diameter is 0.2970 inches. This is a difference of 0.0325 inches, which divided by 2 leads to a neck thickness, $T_{standard}$ of 0.01625. To further this example, an inventive cartridge case 100 can be designed for a .260 projectile, but have a neck Outer diameter of a 0.308. So here, the external neck diameter of a .308 (from FIG. 3A) is 0.3235 inches, less the bullet diameter of a .260, which is 0.2645 inches, leads to a difference of 0.059 inches and a $T_{improved}$ of 0.0295. This is an 81.5% increase in thickness from standard. FIG. 6 illustrates this point as a magnified cross-section of the neck 206 and shoulder 204. Here, the phantom line illustrates the outer wall of a standard cartridge, while the upper solid line is the wall of the example of the present invention.

Figure 7:
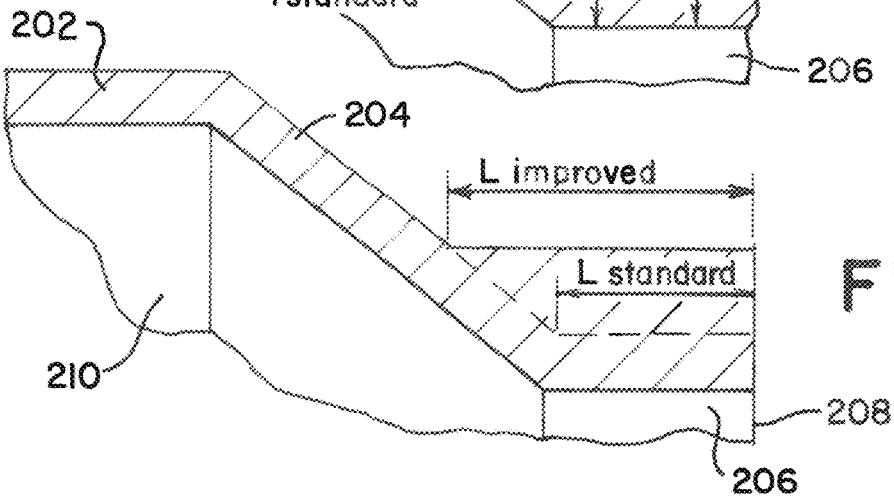
FIG. 7 is a magnified partial cross-section illustrating a longer neck.

In a further example, an angle of the shoulder 204 on the outside of the cartridge 100 is the same as the angle of the shoulder 204 inside the cartridge 100 and the shoulder angle is typically dictated by the caliber of the cartridge. The change in neck thickness $T_{improved}$ does not change the angle of the shoulder 204 as dictated by standards. To accommodate for the change in thickness, a length $L_{improved}$ of the thickened neck 206 is longer than a standard length $L_{standard}$ neck for the same caliber. This allows the shoulder 204 to keep the same angle and thickness. FIG. 7 illustrates this point. As is also evident, a longer neck 206 leads to a shorter shoulder 204 since the thicker neck intersects the shoulder 204 closer to the body than the standard neck 206.

In other examples, the first end and second thickness 222, 230 can differ either changing the external profile of the cartridge or the internal portion of the neck 206 can slope. This slope can accommodate the boat tail of the bullet or other geometric configurations.

The result of the present invention is having an atypically dimensioned polymer cartridge with a particular standard caliber bullet. Typically then a new chamber needs to be designed to fire the round. In the above example, a .260 chamber can be reamed with a .308 reamer, effectively refitting a standard .260 to fire the thicker .260. Also note that the revised cartridge of the example is not a .308. None of the size projectile and the majority of the cartridge dimensions are .308 standard dimensions, just the outer diameter of the neck. The remaining cartridge dimensions (i.e. all except the neck and length of the shoulder) are all the standard dimensions for a particular .260 round.

A method of the present invention can form a mouth of a projectile (step 400), form a neck of the projectile (step 402), form a shoulder of the projectile (step 404), form a body of the projectile (step 406) and attach an insert to the body opposite the mouth (step 408). Where forming the neck includes forming a neck thickness greater than a standard neck thickness as set forth by a standards organization for that particular caliber (step 410). Further, the neck thickness can be set at about 25% to about 90% or about 125% greater than the standard neck thickness (step 412). Additionally, the neck can be formed longer than a standard neck length as set forth by a standards organization for that particular caliber (step 414).

In another example of the present invention, the increase in neck thickness is based off the diameter 212 of the projectile 50. There are numerous cartridges with varied dimensions that utilize the exact same projectile caliber/diameter 212. For example, SAAMI lists nine different cartridges, with differing dimensions, that utilize a .22 caliber projectile. Further, SAAMI lists 20 different cartridge types that all utilize a .30 caliber projectile. The present invention can then be adapted to any of the .22 and .30 caliber cartridges along with any of the variants of any and all other listed bottleneck cartridges for all calibers.

It has been determined that a headspace reference point diameter for any particular cartridge in any particular caliber can control the maximum thickness of the neck. This is because this example of the invention changes none of the other standard dimensions for that particular cartridge except the neck thickness and/or shoulder length.

A headspace is the distance measured from the part of the chamber that stops forward motion of the cartridge (the datum reference) to the face of the bolt. If the headspace is too short, ammunition may not chamber correctly. If headspace is too large, the ammunition may not fit as intended or designed and the cartridge case may rupture, possibly damaging the firearm and injuring the shooter.

Figure 2B:
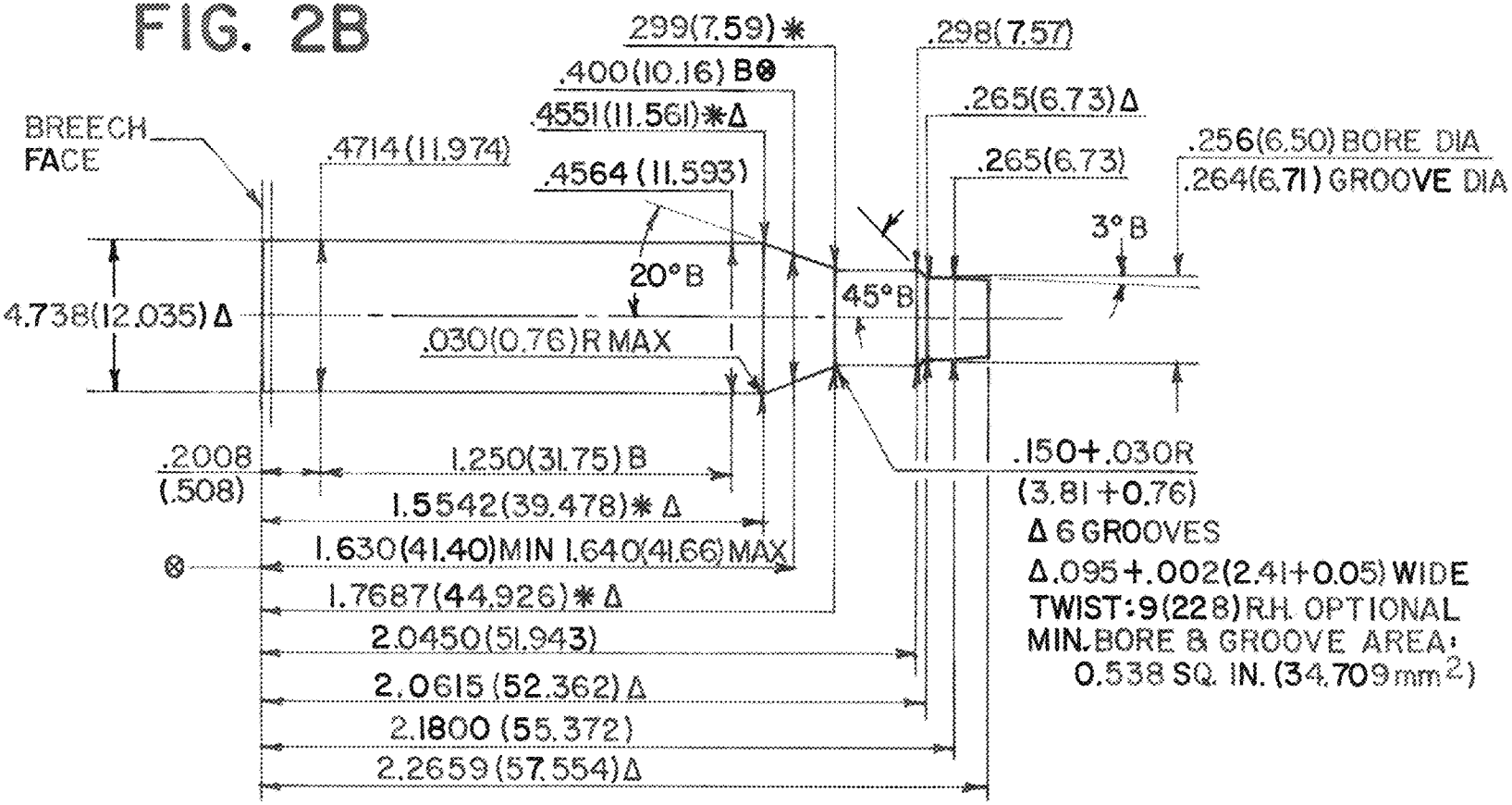
FIG. 2B is a SAAMI performance sheet with dimensions for a .260 Remington chamber.
Figure 3A:
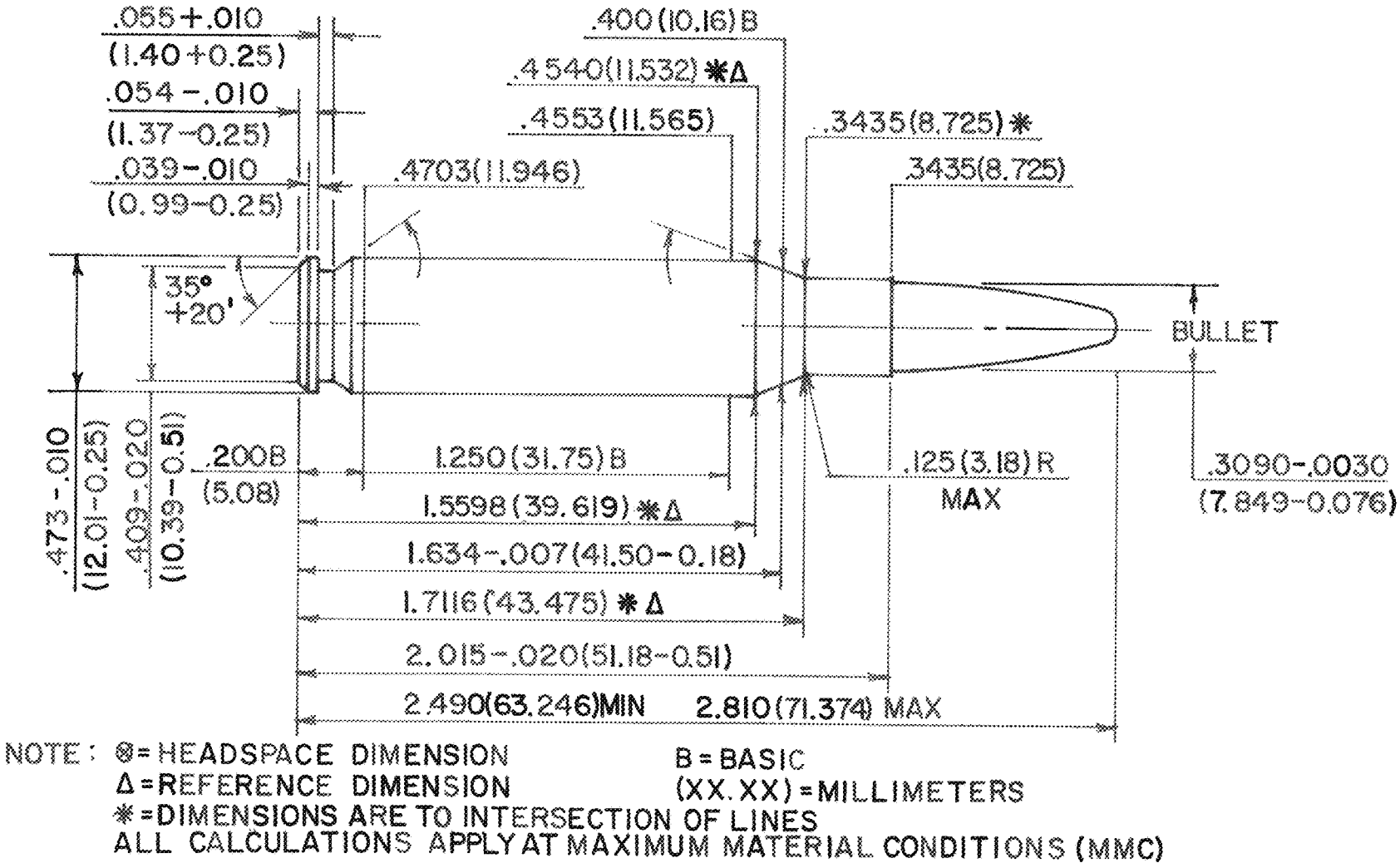
FIG. 3A is a SAAMI performance sheet with dimensions for a .308 Winchester round.
Figure 3B:
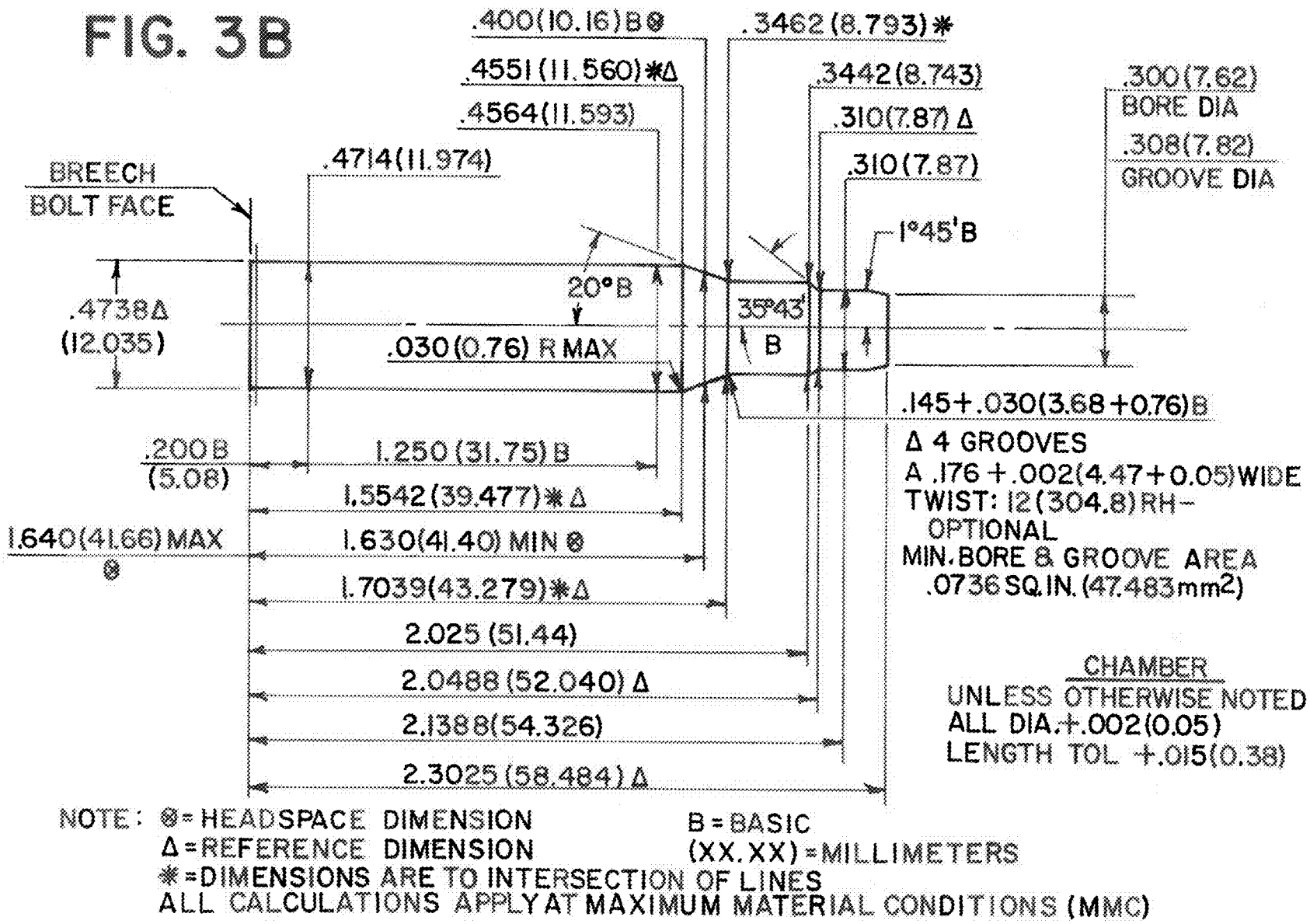
FIG. 3B is a SAAMI performance sheet with dimensions for a .308 Winchester chamber.
Figure 8:
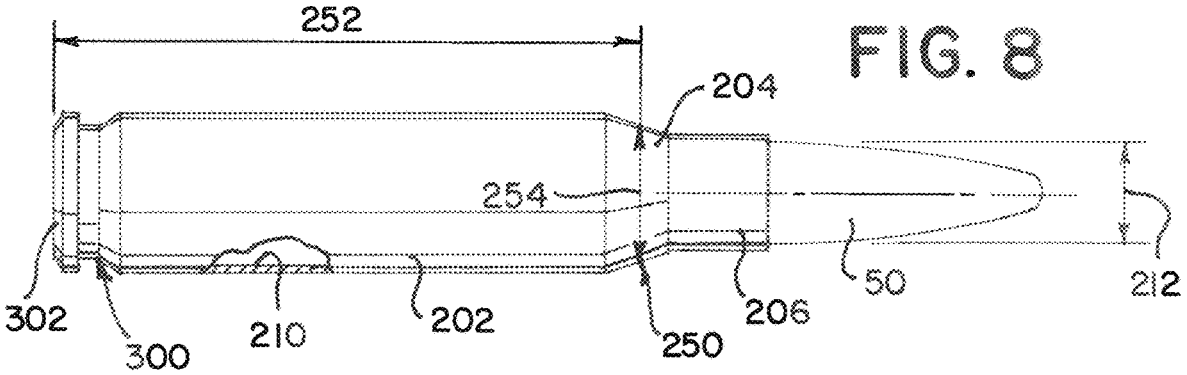
FIG. 8 is another profile view of a cartridge of the present invention.

In FIG. 8, the headspace 252 is measured from a headspace reference point 250 to the back end 302 of the insert 300, which is also the back end of the cartridge. In FIG. 2A the headspace reference point is approximately in the midpoint of the shoulder and the diameter at that point is .400 inch. FIG. 2B has an identically sized diameter for a headspace reference point of the chamber. FIGS. 3A and 3B bear out the same reference points for a .308 Winchester.

Given that the headspace reference point diameter 254 on the cartridge is typically identical to the same point on the chamber, if the neck 206 is thicker than that reference point dimension 254, the cartridge 100 cannot headspace correctly because the diameter of the neck 206 will not pass through that point in the chamber. As an example, if in either the .226 or the .308 Winchester the neck is thickened to even 0.410 inch, the neck 206 cannot pass the headspace point in the chamber (the 0.400 dimensions noted above), thus the cartridge is only chambered to the mouth, and not the midpoint of the shoulder.

It has been found, in general, that the increased neck thickness $T_{improved}$ can range between greater than the maximum standard neck thickness $T_{standard\ max}$ for a particular cartridge and caliber and the thickness/diameter 254 of the headspace reference point 250. The inventors use the projectile diameter 212 as a standard reference point as well.

EXAMPLES

In one example, all of the cartridges that use a .22 caliber projectile were analyzed for their key standard brass dimensions, as listed by SAAMI. Table 1 below lists, in inches, the key cartridge dimensions. The "Cartridge Identifier" is the typical identifier as noted by SAAMI. "Neck 1" is the diameter of the neck closest to the shoulder and "Neck 2" is the diameter of the neck closest to the mouth. Note that some cases have a tapered neck so the average thickness of the neck is used for the percentage in the example. The "Headspace Diameter" is the diameter of the headspace reference point. "Brass Neck Thickness" is calculated as an average of Neck 1 and Neck 2 minus the diameter of the projectile, then divided in half. The "Polymer Maximum Neck Thickness" is the Headspace Diameter minus the diameter of the projectile, then divided in half. These are then turned into a percent ratio of a brass or polymer case neck to the diameter of the projectile. Table 1 provides the standard SAAMI dimensions used, while Table 2 illustrates the inventive concept.

TABLE 1

| 22 cal 0.2245 | | | |
|---|---|---|---|
| Cartridge Identifier | Neck1 Diameter | Neck2 Diameter | Headspace Diameter |
| Hornet | 0.2448 | 0.2425 | 0.262 |
| 22-250 | 0.256 | 0.254 | 0.347 |
| 220 swift | 0.2615 | 0.26 | 0.335 |
| 221 Fireball | 0.253 | 0.253 | 0.33 |
| 222 Rem | 0.253 | 0.253 | 0.33 |
| 222 Rem Mag | 0.253 | 0.253 | 0.33 |
| 223 Rem | 0.253 | 0.253 | 0.33 |
| 223 Win SS Mag | 0.272 | 0.272 | 0.445 |
| 225 Win | 0.26 | 0.26 | 0.35 |

TABLE 2

| 22 cal | | | | |
|---|---|---|---|---|
| Cartridge Identifier | Brass Neck Thickness | Poly Max Neck Thickness | Brass Neck/Bullet | Poly Max Neck/Bullet |
| Hornet | 0.009575 | 0.01875 | 4.3% | 8.4% |
| 22-250 | 0.01525 | 0.06125 | 6.8% | 27.3% |
| 220 swift | 0.018125 | 0.05525 | 8.1% | 24.6% |
| 221 Fireball | 0.01425 | 0.05275 | 6.3% | 23.5% |
| 222 Rem | 0.01425 | 0.05275 | 6.3% | 23.5% |
| 222 Rem Mag | 0.01425 | 0.05275 | 6.3% | 23.5% |
| 223 Rem | 0.01425 | 0.05275 | 6.3% | 23.5% |

TABLE 2-continued

| 22 cal | | | | |
|---|---|---|---|---|
| Cartridge Identifier | Brass Neck Thickness | Poly Max Neck Thickness | Brass Neck/Bullet | Poly Max Neck/Bullet |
| 223 Win SS Mag | 0.02375 | 0.11025 | 10.6% | 49.1% |
| 225 Win | 0.01775 | 0.06275 | 7.9% | 28.0% |
| min | 0.009575 | 0.01875 | 4.3% | 8.4% |
| max | 0.02375 | 0.11025 | 10.6% | 49.1% |
| avg | 0.015716667 | 0.057694444 | 7.0% | 25.7% |

As is shown in the example, just in brass, the neck can be between 4.3% and 10.6% thicker than the diameter of the .22 caliber projectile. Once in polymer, the neck can be up to 49.1% thicker than the diameter of the .22 caliber projectile. In one instance, the neck thickness can be greater than 4.3% and less than or equal to 49.1% than the diameter of the .22 caliber projectile. These ratios can be carried through so that the thickened neck is always greater than the average standard neck thickness and less than or less than or equal to the headspace reference point diameter as compared to a projectile diameter.

The same calculations were performed in .30 caliber to bear out the nature of the invention. Tables 3 and 4 illustrate data for those standard variants.

TABLE 3

| 30 cal 0.309 | | | |
|---|---|---|---|
| Cartridge Identifier | Neck1 Diameter | Neck2 Diameter | Headspace Diameter |
| 30 carbine | 0.336 | 0.336 | |
| 30 nosler | 0.344 | 0.344 | 0.42 |

TABLE 3-continued

| 30 cal 0.309 | | | |
|---|---|---|---|
| Cartridge Identifier | Neck1 Diameter | Neck2 Diameter | Headspace Diameter |
| 30 Rem AR | 0.342 | 0.341 | 0.4 |
| 30 Thompson | 0.337 | 0.337 | 0.4 |
| 30-06 Springfield | 0.3397 | 0.3397 | 0.375 |
| 30-30 win | 0.3331 | 0.3301 | 0.375 |
| 30-40 Krag | 0.3389 | 0.338 | 0.375 |
| 300 AAC | 0.334 | 0.334 | 0.3512 |
| 300 H&H Mag | 0.338 | 0.338 | 0.375 |
| 300 Rem SA Ultra Mag | 0.344 | 0.344 | 0.45 |
| 300 REM Ultra Mag | 0.344 | 0.344 | 0.42 |
| 300 Ruger Compact Mag | 0.34 | 0.34 | 0.42 |
| 300 Savage | 0.3407 | 0.339 | 0.3968 |
| 300 Weatherby Mag | 0.337 | 0.337 | 0.4276 |
| 300 Win Mag | 0.3397 | 0.3397 | 0.42 |
| 300 Win Short Mag | 0.344 | 0.344 | 0.445 |
| 303 British | 0.34 | 0.338 | 0.375 |
| 307 Win | 0.3435 | 0.3435 | 0.4 |
| 308 Marlin | 0.337 | 0.337 | 0.4 |
| 308 Win | 0.3435 | 0.3435 | 0.4 |

TABLE 4

| 30 cal | | | | |
|---|---|---|---|---|
| Cartridge Identifier | Brass Neck Thickness | Poly Max Neck Thickness | Brass Neck/Bullet | Poly Max Neck/Bullet |
| 30 carbine | 0.0135 | | 4.4% | |
| 30 nosler | 0.0175 | 0.0555 | 5.7% | 18.0% |
| 30 Rem AR | 0.01625 | 0.0455 | 5.3% | 14.7% |
| 30 Thompson | 0.014 | 0.0455 | 4.5% | 14.7% |
| 30-06 Springfield | 0.01535 | 0.033 | 5.0% | 10.7% |
| 30-30 win | 0.0113 | 0.033 | 3.7% | 10.7% |
| 30-40 Krag | 0.014725 | 0.033 | 4.8% | 10.7% |
| 300 AAC | 0.0125 | 0.0211 | 4.0% | 6.8% |
| 300 H&H Mag | 0.0145 | 0.033 | 4.7% | 10.7% |
| 300 Rem SA Ultra Mag | 0.0175 | 0.0705 | 5.7% | 22.8% |
| 300 REM Ultra Mag | 0.0175 | 0.0555 | 5.7% | 18.0% |
| 300 Ruger Compact Mag | 0.0155 | 0.0555 | 5.0% | 18.0% |
| 300 Savage | 0.015425 | 0.0439 | 5.0% | 14.2% |
| 300 Weatherby Mag | 0.014 | 0.0593 | 4.5% | 19.2% |
| 300 Win Mag | 0.01535 | 0.0555 | 5.0% | 18.0% |
| 300 Win Short Mag | 0.0175 | 0.068 | 5.7% | 22.0% |
| 303 British | 0.015 | 0.033 | 4.9% | 10.7% |
| 307 Win | 0.01725 | 0.0455 | 5.6% | 14.7% |
| 308 Marlin | 0.014 | 0.0455 | 4.5% | 14.7% |
| 308 Win | 0.01725 | 0.0455 | 5.6% | 14.7% |
| min | 0.0113 | 0.0211 | 3.7% | 6.8% |
| max | 0.0175 | 0.0705 | 5.7% | 22.8% |
| avg | 0.015295 | 0.046173684 | 4.9% | 14.9% |

Here the ranges can run between 3.7% and 22.8% based on the smallest brass neck thickness and the largest polymer thickness based on the headspace calculations above.

Note also that the neck thicknesses can be tapered if the existing standard cartridge has a neck that varies in thickness as noted in the Neck 1 and Neck 2 columns. Percent ratio thicknesses can also be calculated at each of those points.

Figure 9:
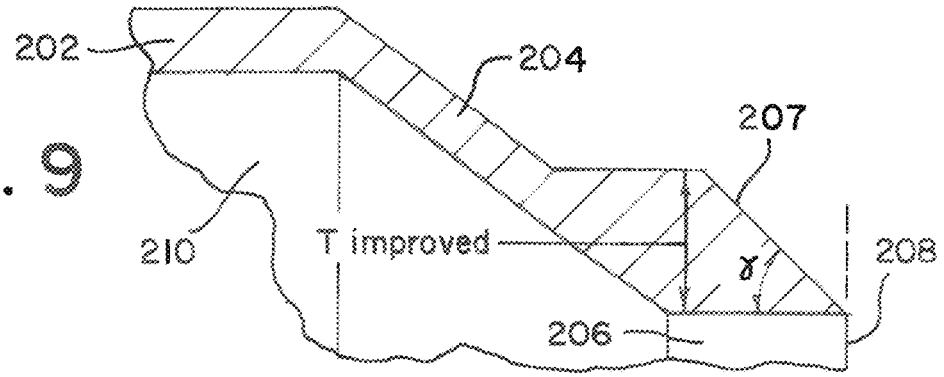
FIG. 9 is a partial cross-section illustrating an angle cut in the thicker neck.

In another example, illustrated in FIG. 9, an edge 207 of the neck 206 or mouth 208 is, in a typical cartridge, a flat or square edge. However, the edge 207 can be angled y in relation to a vertical plane or the inner wall of the neck 206. The angle $\alpha$ in a standard cartridge, and some examples of the present invention, is 90° and presents a straight or blunt edge face. In this example, the angle is less than 90° forming a sloped edge 207. The sloped edge 207 can help facilitate the loading of the cartridge 100 into the chamber given the thickened neck. Values for the angle $\alpha$ can be 20°, 30°, 40°, 45°, 60°, 70°, 75°, 80° and any range in between any of the listed values.

The sloped edge 207 is separate from any taper caused by a variance between the thicknesses Neck 1 and Neck 2, as noted above. In one example, the slope of the sloped edge 207 is steeper than the taper of the neck. The slope runs from an outside wall of the neck to an inside wall to facilitate the neck's entry into the chamber when the cartridge is loaded. Examples can include a sloped edge on any of the above examples of a thickened neck.

In different example of the present invention, the insert 300 can be fit to the cartridge 100 in a number of different ways. Numerous ways have been identified by both this inventor and the prior art. One method is that the insert 300 is dry snap fit on to the cartridge, see, for example, U.S. Pat. Nos. 3,099,958 and 5,063,853. There are also different methods of over and under molding the insert into the polymer of the cartridge body, see, for example, applications by the same inventor. However, none of them disclose using an adhesive to glue the insert 300 to the cartridge body 202 and the particular method to do so. Here, the adhesive can be wiped, sprayed, slung and dipped.

An example of a method of making is forming the elements of the cartridge, including the mouth, shoulder, body and insert having standard dimensions from a standards setting organization. Also, forming the neck with at least one of the increased thickness or increased length as described above. The increased thickness can be tapered. The mouth edge can also be formed with a sloped edge. The slope can be formed with a range of angles.

Note that the cartridge 100 and the insert 300 can be formed and/or have any of the features as disclosed in the other applications by the present inventor. Notably, the below applications are all incorporated herein by reference in their entirety. U.S. Provisional Application Ser. No. 61/433,170 filed Jan. 14, 2011; U.S. Provisional Application Ser. No. 61/509,337 filed Jul. 19, 2011; U.S. Provisional Application Ser. No. 61/532,044 filed Sep. 7, 2011; U.S. Provisional Application Ser. No. 61/555,684 filed Nov. 4, 2011; U.S. application Ser. No. 13/350,585 filed Jan. 13, 2012; U.S. application Ser. No. 13/828,311 filed Mar. 14, 2013; U.S. application Ser. No. 14/041,709 filed Sep. 30, 2013; U.S. application Ser. No. 14/482,843 filed Sep. 10, 2014 now U.S. Pat. No. 9,599,443; U.S. application Ser. No. 14/531,124 filed Nov. 3, 2014 now U.S. Pat. No. 9,261,335; U.S. application Ser. No. 14/642,922 filed Mar. 10, 2015 no U.S. Pat. No. 9,372,054; U.S. application Ser. No. 29/499,958 filed Aug. 20, 2014 now U.S. Pat. Nos. D765,214; D715,888 filed Mar. 14, 2013, and issued Oct. 21, 2014; U.S. Pat. No. 8,443,730 filed Jan. 13, 2012, and issued May 21, 2013; U.S. Pat. No. 8,573,126 filed on Jul. 30, 2010, and issued on Nov. 5, 2013; U.S. Pat. No. 8,763,535 filed Jul. 13, 2012, and issued on Jul. 1, 2014; U.S. Pat. No. 8,807,008 filed Mar. 15, 2013, and issued Aug. 19, 2014; U.S. Pat. No. 8,875,633 filed Apr. 17, 2013 and issued Nov. 4, 2014; U.S. Pat. No. 9,003,973 filed Jun. 26, 2014, and issued Apr. 14, 2015; U.S. Pat. No. 9,194,680 filed Aug. 15, 2014, and issued Nov. 24, 2015; and U.S. Provisional Application Ser. No. 62/319,609 filed Apr. 7, 2016. These applications provide for supersonic and subsonic rounds, variable assembly methods and both cartridge and insert variants. The present invention can be adapted to any of the advancements in polymer cased ammunition.

Another advantage of the polymer design is its insulation properties. The polymer disclosed herein is a superior insulator to brass. This leads to a number of advantages. An advantage during firing is that less heat can be transferred to the cartridge/chamber. This can provide more energy to propel the bullet, since the energy is not heating its surroundings. This can also be a cause for the greater muzzle velocities discussed above. This is evidenced by observational data in which brass extracted from a firearm is very hot to the touch while, in contrast, the polymer rounds can be handled without discomfort immediately after being extracted from the chamber.

Less heat exchanged to the chamber can lead to a longer service life for the chamber/firearm. Constantly heating and cooling metals can alter their properties. Further, more rounds can be fired through the barrel before it becomes too hot, where high heat can lead to "baking" the fouling in the barrel which in turn can result in a significant loss of accuracy.

Another benefit of a better insulated cartridge case is that it can insulate the powder from the external storage temperatures. Preventing the temperature of the powder from deviating from its optimal range greatly aids in consistent ballistic performance. Studies have been performed linking changes in the peak pressures generated to changes in the temperature of the powder in the cartridge (see, for example http://www.shootingsoftware.com/ftp/Pressure%20Factors.pdf, last visited Jan. 12, 2011).

The polymer construction of the cartridge case also provides a feature of reduced friction between the cartridge and chamber of the firearm. Reduced friction leads to reduced wear on the chamber, further extending its service life.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

We claim:

1. A high strength polymer-based cartridge casing enclosing a volume, comprising:

a first end having a mouth;

a neck extending away from the mouth;

a shoulder extending below the neck and away from the first end;

a cartridge body formed below the shoulder;

an insert attached to the cartridge body opposite the shoulder; and a projectile disposed in the mouth having a particular caliber;

the neck comprises a neck thickness that is about 25% to about 125% greater than a standard neck thickness for the particular caliber as detailed by a standards organization, the neck, the shoulder, and the cartridge body are formed from a polymer, and the standards organization is at least one of the Sporting Arms and Ammunition Manufacturers' Institute (SAAMI), the Commission Internationale Permanente pour l'epreuve des armes a feu portatives (CIP), and the North Atlantic Treaty Organization (NATO).

2. The high strength polymer-based cartridge casing of claim 1, wherein the neck thickness that is about 25% to about 90% greater than a standard neck thickness for the particular caliber as detailed by the standards organization.

3. The high strength polymer-based cartridge casing of claim 1, wherein the neck further comprises a length greater than a standard neck length for the particular caliber as detailed by the standards organization.

4. The high strength polymer-based cartridge casing of claim 1, wherein the shoulder has a shoulder angle and the angle remains constant for the particular caliber as detailed by the standards organization.

5. A high strength polymer-based cartridge casing enclosing a volume, comprising:

a first end having a mouth;

a neck extending away from the mouth;

a shoulder extending below the neck and away from the first end;

a cartridge body formed below the shoulder;

an insert attached to the cartridge body opposite the shoulder; and a projectile disposed in the mouth having a particular caliber;

the neck further comprises:

a neck thickness greater than a thickest neck of a standard cartridge in the particular caliber as detailed by a standards organization, and the standards organization is at least one of the Sporting Arms and Ammunition Manufacturers' Institute (SAAMI), the Commission Internationale Permanente pour l'epreuve des armes a feu portatives (CIP), and the North Atlantic Treaty Organization (NATO).

6. The high strength polymer-based cartridge casing of claim 5, further comprising a sloped neck edge proximate the first end.

7. The high strength polymer-based cartridge casing of claim 6, wherein a slope of the sloped neck edge is defined by an angle.

8. The high strength polymer-based cartridge casing of claim 7, wherein the angle is between 20° and 80°.

* * * * *